United States Patent [19]

Bagley

[11] 3,967,821

[45] July 6, 1976

[54] BALL SEPARATING DEVICE FOR POOL TABLES AND THE LIKE

[75] Inventor: Stuart C. Bagley, Glen Ellyn, Ill.

[73] Assignee: Armac Enterprises, Inc., Chicago, Ill.

[22] Filed: Dec. 5, 1974

[21] Appl. No.: 529,805

[52] U.S. Cl. ..... 273/11 C; 209/85

[51] Int. Cl.[2] ..... A63D 15/00

[58] Field of Search ..... 273/11 R, 11 C, 12, 273/3 R, 8, 10, 39, 47, 48, 49; 209/85, 71, 83, 90, 93, 97, 98, 99, 112, 86, 126; 46/40, 43; 193/7, 14, 25 E, 25 FT; 133/3 R, 3 C, 3 D; 211/10

[56] References Cited

UNITED STATES PATENTS

| | | | |
|---|---|---|---|
| 817,504 | 4/1906 | McCarthy | 273/47 |
| 2,482,250 | 9/1949 | Discher | 273/47 |
| 2,586,718 | 2/1952 | Rodock | 273/47 |
| 3,096,981 | 7/1963 | Fischer | 273/11 C |
| 3,115,341 | 12/1963 | Feddick et al. | 273/11 C |
| 3,455,445 | 7/1969 | Allen et al. | 209/85 |
| 3,466,037 | 9/1969 | Miller | 273/11 C |
| 3,497,048 | 2/1970 | Le Mieux | 273/11 C X |

FOREIGN PATENTS OR APPLICATIONS

| | | | |
|---|---|---|---|
| 468,894 | 2/1952 | Italy | 209/85 |
| 13,211 | 1894 | United Kingdom | 273/11 R |

*Primary Examiner*—Richard C. Pinkham
*Assistant Examiner*—Arnold W. Kramer
*Attorney, Agent, or Firm*—Hill, Gross, Simpson, Van Santen, Steadman, Chiara & Simpson

[57] ABSTRACT

A device for separating a ball, such as a cue ball from other balls, for example numbered balls of slightly smaller diameter than the cue ball, in which the balls are guided by track elements, in a directionally stable relation, to a separating station, with the track elements preferably being so constructed that the stable support thereby, at the separating station is terminated for all such balls, and a further track element disposed at the separating station, out of the path of smaller balls, for guiding the larger ball, in a stable relation from said separating station, whereby the smaller balls may move, in a different direction than the larger ball, unrestricted by further track elements, out of the separating station.

8 Claims, 6 Drawing Figures

BALL SEPARATING DEVICE FOR POOL TABLES AND THE LIKE

BACKGROUND OF THE INVENTION

The invention is directed to a ball separating device, for segregating at least one ball from a plurality of other balls, for example, for segregating the cue ball with respect to a plurality of numbered playing balls.

In coin-operated pool tables and the like, a numbered ball when received in one of the pockets is conducted to a ball-retaining container or the like whereby they are not accessible to the player or players using the table so that upon completion of a game with all of the balls pocketed, an additional coin must be deposited to release the balls for further play. However, as the cue ball may also be pocketed, i.e. a scratch shot, in the middle of the game, whereby such cue ball is necessary to complete the game, some provision must be made to insure the return of the cue ball to the players instead of deposition in the ball-retaining container with the numbered balls. Suitable means must therefore be employed to differentiate between the cue ball and the other balls, whereby the cue ball when pocketed will be returned to the player but the numbered balls will be deposited in the container therefor.

Two basic concepts immediately present themselves, either there must be a difference in size between the cue ball and the other balls sufficient to enable determination and segregation thereof or the construction of the cue ball must be different from the other balls to enable segregation to be made on the basis of the differences in construction.

For example, the cue ball may be provided with metallic or magnetic means whereby a suitable selection can be made employing a magnetic field or the like. Such a construction, for example, is illustrated in U.S. Pat. No. 3,738,655 in which the cue ball is provided with imbedded loops of magnetic material with the ball being magnetically guided along a different path than the numbered balls.

This type of separation has the important disadvantage that the specially constructed cue balls are costly, approximately three to four times the ordinary ball. As the most expensive ball, the cue ball, is the one ball which is not retained, following pocketing, it is readily capable of being appropriated with attendant high replacement cost.

An example of a separating structure, utilizing difference in size between the cue ball and the numbered balls, is illustrated in U.S. Pat. No. 3,096,981 in which the balls are conducted down an incline over which extends a deflector member positioned at a height to permit the smaller balls to pass beneath the same but engageable with the larger cue ball to deflect the same laterally. It will be apparent that to provide a substantially fool-proof operation, an abutment type of separation requires a sufficiently great difference between the size of the numbered balls and the size of the cue ball to insure adequate separation under all conditions and with balls having a size within a reasonable tolerance. It is customary, in separating devices utilizing a size difference such as the above example, to employ a cue ball which is ⅛ of an inch oversized. While the utilization of separation based on size provides a simple construction, as well enabling the use of an inexpensive cue ball of standard construction, i.e. without additional inserts, etc., the disadvantage exists that the increased size of the cue ball is readily apparent and thus differentiates the game from a standard game employing cue and numbered balls of the same size and consequently has a detracting influence on use of the coin-operated table.

It will be appreciated that in the conduction of balls of the type involved, normally constructed of a suitable plastic, the balls are subject to wear, particularly if the wearing points are relatively concentrated as they would be where a spin is imparted to the ball, i.e. rotary motion of the ball about the substantially vertical axis as distinguished from rolling motion of the ball about a substantially horizontal axis. Consequently, wherever possible it is preferable to insure rolling movement and minimize spinning movement. It will be appreciated that with abutment type of separating structures, such as illustrated in the second of the two patents referred to, the large ball, while moving down an incline under the action of gravity strikes a transversely extending abutment whereby the rolling motion of the ball is abruptly terminated by impact and the ball then proceeds in the transverse direction with a spinning movement, substantially on the vertical axis due to its engagement with the abutment, with substantially all travel taking place with a spinning movement. Consequently, balls employed with this type of separating device generally tend to show excessive wear over a period of time.

BRIEF SUMMARY OF THE INVENTION

The present invention is directed to a separating arrangement in which the cue ball may be of standard construction without inserts, etc., and, while of increased size over the numbered balls, involves an increase in size which is substantially imperceptible and thus for practical purposes, insofar as the players are concerned, may be considered to be of substantially the same size as the numbered ball. It will be appreciated that where size of ball is involved, consideration must be given to size tolerances involved in the manufacture of such balls for example, employing balls of 2¼ in diameter, and assuming a maximum plus tolerance in manufacture of 0.010 inch, the maximum diameter for the numbered balls would be 2.260 inches. With balls of these dimensions, the cue ball may readily be designed with a minimum diameter of 2.270 whereby average difference between the cue and numbered balls would be 0.020 inch, which is substantially imperceptible without close examination and comparison.

In accordance with the invention guide means is provided for guiding all of the balls, i.e. cue and numbered balls in a stable relation to a separating station with such guide means preferably being so constructed that stable support thereby at the separating station is terminated for all such balls with a further means disposed at the separating station, out of the path of smaller balls for guiding the larger ball in a stable relation from separating station in a predetermined direction whereby the smaller balls may move unrestricted by said further guide means, in a different direction, out of engagement with said first guide means.

In accordance with a preferred form of the invention, the guide means is fabricated from rod or wire stock, which is considerably smaller in diameter than the balls involved, for example on the order of ¼ inch, in which the rods may be disposed in spaced relation to form a track for guiding balls to the separating station and for guiding at least the larger ball through such station while permitting the smaller balls to be directed out of the separating station in a different direction from that of the larger ball, thus segregating the same.

In a preferred form of the invention, the respective guide means comprises a pair of rods, which thus are common to both of such guide means, one of the rods being a straight section and the other comprising a pair of spaced aligned sections and an intermediate section, which extends parallel to spaced sections, and is connected at its ends to the latter by means of arcuate shaped sections having a curvature which will permit the balls to pass thereby. The straight section, in conjunction with one of the aligned sections, forms the guide means to the separating station while the intermediate section cooperates with a portion of the straight section to form the guide means for the larger ball, the spacing between the two rods forming such guide means being less than the minimum diameter of the larger ball and greater than the maximum diameter of the smaller ball whereby such means will guide the larger ball through the separating station, while permitting the smaller ball to move out of engagement with such straight section of the first guide means, and subsequently directed from the separating station.

It will be appreciated that, in comparison with prior devices such as that heretofore referred to, employing size differentiation, the present invention does not involve extensive travel of the balls with other than a rolling movement of the ball, as distinguished from spin, heretofore referred to. Consequently, the separating device of the present invention, not only permits a separation on a considerably smaller differential between the ball sizes but also eliminates spin on a vertical axis and reduces spin, along any other axis than horizontal, to a minimum, with the bulk of the movement being rolling motion. This is true both as to the cue ball, any spin imparted thereto when traveling through the intermediate section being only momentary, while movement of the smaller balls from the separating station again involves rolling movement.

In the preferred form of the present invention all the balls may travel in a substantially straight line into the separating station with the cue ball continuing in such straight line with the travel of the large ball having substantially only a rolling movement along the intermediate section of the structure, and likewise is discharged therefrom with purely a rolling movement. On the other hand, the smaller balls are permitted to roll out of the separating station with their rolling motion relatively little changed. Likewise, the construction is such that no rigid abutments are involved and engagement of the larger ball with the guide means therefore is relatively gradual being generally tangential without sharp impact, the rolling axis merely being temporarily displaced as the ball travels through the separating station.

BRIEF DESCRIPTION OF THE DRAWINGS

In the drawings wherein like reference characters indicate like or corresponding parts.

DETAILED DESCRIPTION OF THE INVENTION

General

Figure 1:
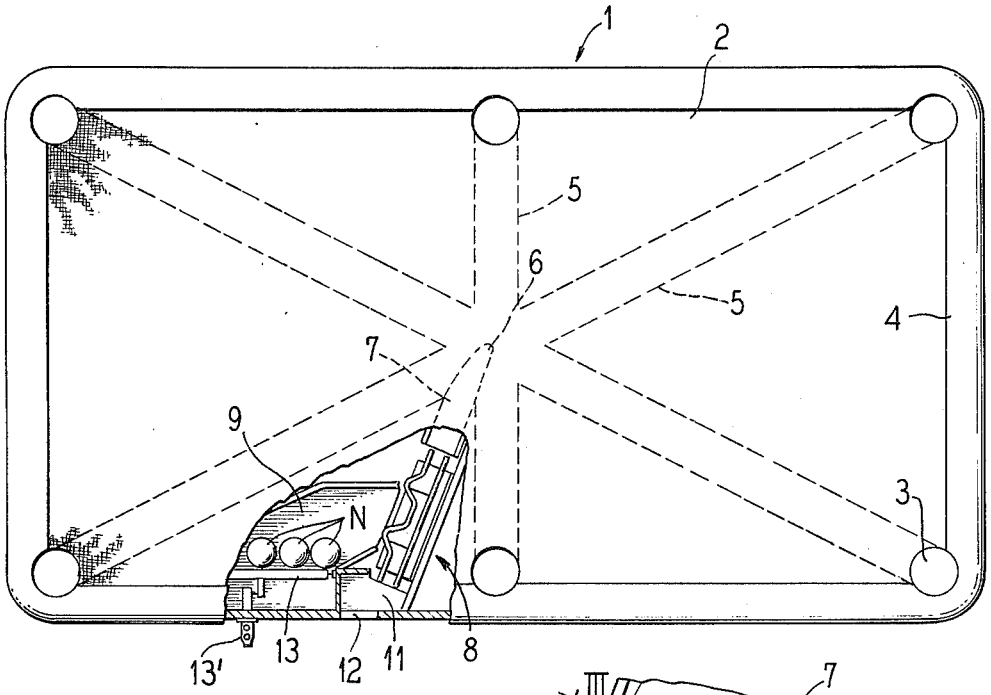
FIG. 1 is a top plan view of a pool table with a portion thereof broken away to illustrate the application of the present invention thereto.

Referring to the drawings, and particularly to FIG. 1 there is illustrated a plan view of a pool table or the like, indicated generally by the numeral 1, of generally standard construction, having a playing surface 2, pockets 3 and side bumpers 4, the pockets being constructed to deposit balls received therein into respective inclined ball-conducting channels 5 which are adapted to convey balls received in any one of the pockets, by the action of gravity, to a central point 6 at the intersection of the respective channels where the balls may enter a downwardly sloping ramp 7 to a ball separating device, indicated generally by the numeral 8. The separating device is adapted to separate the cue ball from the remaining numbered balls, depositing the latter in a container 9 and the cue ball in a compartment 11, at which it is accessible from the exterior through an opening 12 in the adjacent side wall of the table structure. The numbered balls N are adapted to be retained in the container 9 by suitable means such as a movable gate member 13, which will normally retain the balls in the container 9 until a coin-operated mechanism 13' is actuated to open the gate 13 and permit the balls N to move into a convenient gutter or tray, accessible from the exterior of the table whereby the balls may be returned to the table surface for a new game.

DETAILS OF THE SEPARATING MECHANISM

Figure 2:
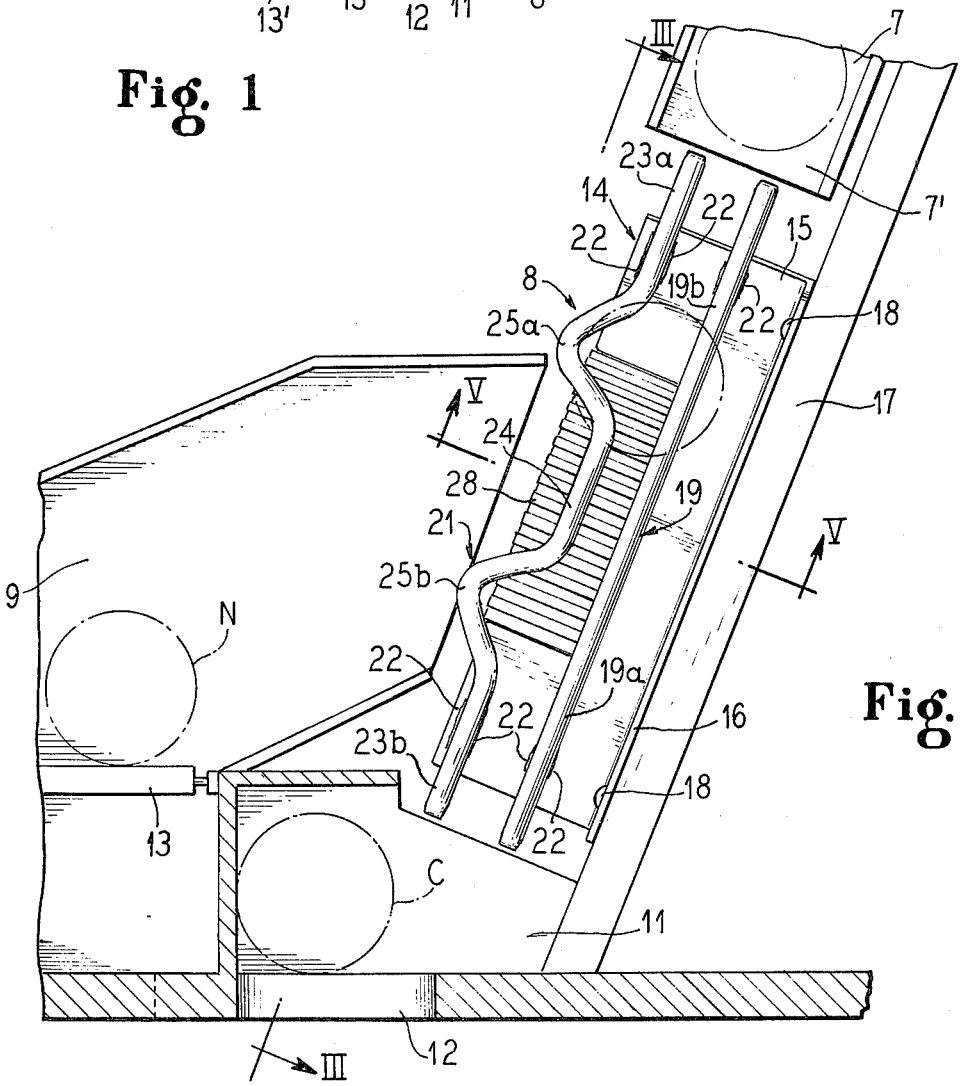
FIG. 2 is an enlarged plan view of the portion of FIG. 1 broken away, to better disclose the details of the invention.

The ball separating mechanism 8 employs no movable parts and is extremely simple in construction, the illustrated preferred embodiment comprising an angle member 14 having a generally horizontal bottom wall 15 and a vertical wall 16, the latter being suitably secured to a rigid portion of the table structure, as for example a wall member 17, with the separating device being rigidly secured thereto by suitable means such as a plurality of screws 18 passing through the vertical wall 16 and into the wall member 17. Secured to the bottom wall 15 are a pair of rod elements indicated generally by the numerals 19, 21, respectively, which are rigidly mounted on the wall 15 by suitable means, as for example welding 22, to provide a rigid integral structure. As will be clearly apparent from a reference to FIGS. 2–4, the rod 19 is a straight section while the rod 21 is provided with straight aligned end sections **23*a* and 23*b* and an intermediate section 24 connected to the aligned sections 23*a* and 23*b* by respective generally arcuate-shaped connecting portions 25*a* and 25*b*.**

The bottom wall 15 of the angle member 14 is severed along two longitudinally spaced lines 26 which extend substantially to the rod 19, with the intermediate portion 27 being bent downwardly to form a discharge ramp for the numbered balls. Such ramp may be suitably covered with a more or less resilient covering 28 adapted to cushion the ball action and reduce noise during movement of the numbered balls out of the separating station.

Figure 6:
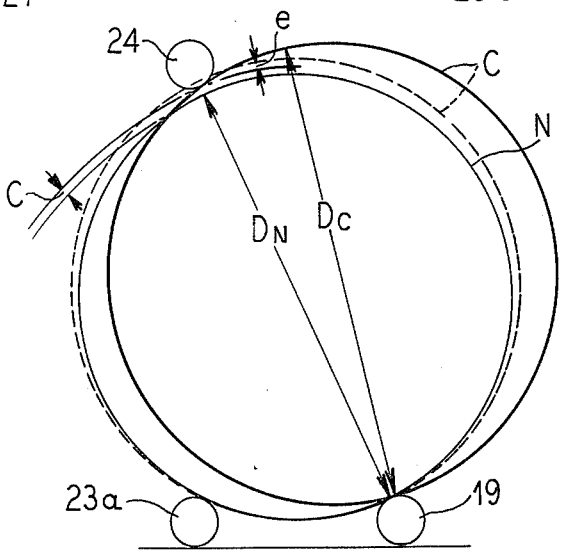
FIG. 6 is a schematic figure illustrating the relationships of the guide structures and the respective balls in the embodiment of the invention illustrated in FIGS. 1–5.

As illustrated in FIG. 6, the intermediate section 24 is so disposed with respect to the rail 19 that the spacing therebetween is greater than the diameter of the smallest numbered balls but less than the diameter of the larger cue ball.

Thus, assuming that the small balls are to have a design diameter of 2.250 inches, with a manufacturing tolerance of 0.010 inch, the maximum diameter of a numbered ball would be 2.260 inches, and with a minimum diameter of the cue ball of 2.270 inches, the cue ball would be approximately 0.020 inch oversized. Even assuming 0.030 inch oversize, the diameter increase would be less than 1% over the nominal diameter of the numbered balls as compared with over a 5% increase in diameter in currently employed oversized cue balls of 2.375 inches in diameter, i.e. one-eighth inch or 0.125 inch .

Assuming the use of numbered balls having a maximum diameter of 2.260 inch and a cue ball having a minimum diameter of 2.270 inches, the intermediate section 24 would be spaced from the rod 19 by substantially the mean of the diameters of the two balls which, in the example, would be 2.265 inch. The clearance between the rod section 24 and the numbered ball N is designated in FIG. 6 by the reference character c while the enlargement of the cut ball C thereover is indicated by the reference character *e* with $c = e$ in this example.

As illustrated in FIG. 6, with such clearances the intermediate section 24 will normally be disposed at a point in which it will impart a slight lift to the cue ball, elevating it slightly over the position the ball initially occupied when first entering the separating structure.

OPERATION

Figure 3:
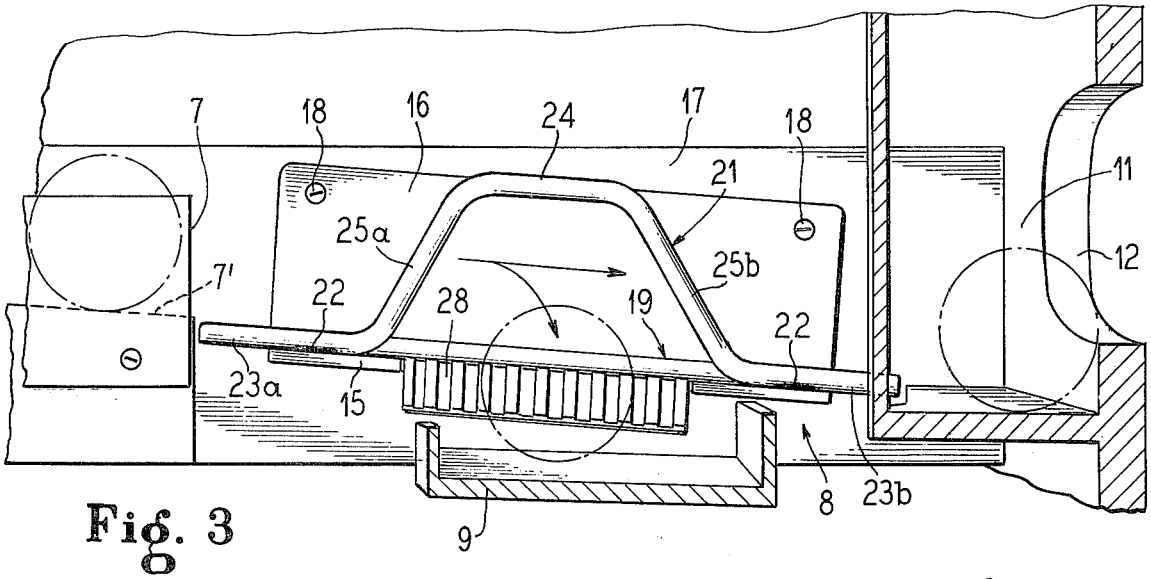
FIG. 3 is a sectional view taken approximately on the line III—III of FIG. 2, illustrating the separating structure in elevation.
Figure 5:
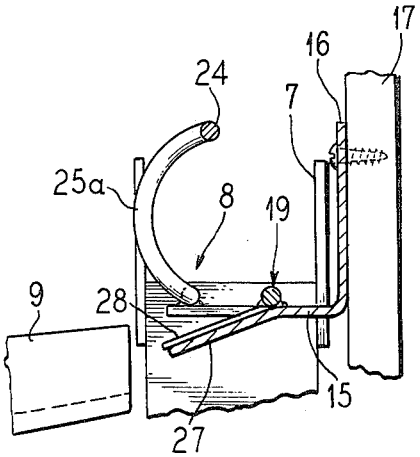
FIG. 5 is a sectional view taken approximately on the line V—V of FIG. 2.
Figure 4:
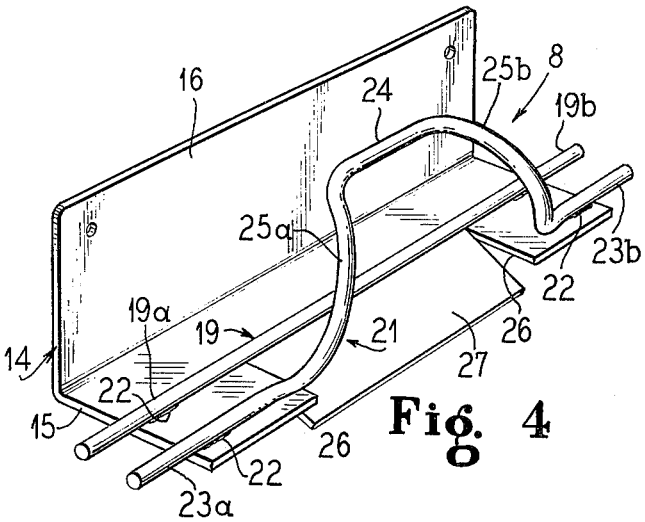
FIG. 4 is a perspective view of the separating structure illustrated in FIGS. 2 and 3.

The device 8, as illustrated in FIG. 3, is mounted with the bottom wall 15 in inclined relation, whereby the rod 19 and the aligned sections 23*a* and 23*b* of the rod 21 are disposed in the plane of the bottom 7′ of the ramp 7, whereby balls may readily roll from the ramp 7 onto the track defined by the portions 19*a* and 23*a*, which thus form the means for guiding balls into the separating station, which is generally defined by the intermediate portion 24 and the ramp 27. Likewise, the section 24 of the rod 21 is cooperable with the intermediate portion of the rod 19 to define additional guide means, with the section 24 being disposed out of the path of the numbered balls. The discharge track, formed by the end 19*b* of the rod 19 and end 23*b* of the rod 21, are disposed to deposit a cue ball passing through the separating structure into the compartment 11. In like manner, the ramp 27 is adapted to receive numbered balls following disengagement thereof with the rod 21, whereby such balls may move laterally down the ramp 27 intto the container 9.

In the particular embodiment of the invention illustrated all balls thus are guided in stable relation by the guide means comprising the rods sections 19*a*, 23*a* until the balls reach the separating station, at which the numbered balls are disengaged from the rod 21 and thus lose the lateral support initially supplied by the section 23*a*. As the distance between the section 24 and the rod 19 is greater than the maximum diameter of the numbered balls, such balls are free to move by the action of gravity down the ramp 27, under the section 24, and into the container 9. On the other hand, the section 24 of the rod 21, as well as the connecting portion 25*a*, are operative to maintain stable support of the larger cue ball, the latter merely being tilted slightly from its original position on entering the separating station, and such ball will therefore travel along the section 24, ultimately riding on the paralled track portions 19*b* and 23*b* of the two rods, which will then guide the cue ball into the compartment 11.

It will be appreciated that at no time do any of the balls strike a rigid abutment which blocks the path of a ball resulting in impact of the ball thereon, as well as possibly imparting undesired spin to the ball.

Tests have indicated that while the numbered balls, rolling down the ramp 7 and rod sections 19*a*, 23*a*, on substantially horizontal axis, will initially at the portion 25*a* have imparted thereto a slight shift in the rolling axis, as the balls leave the ramp 27 and roll into the compartment 9, they will be rolling on an axis very close to their previous rotative axis prior to entry into the separation station. Likewise, the larger cue ball, while having a tilted rotative axis while traveling along the section 24, upon reaching the track portion defined by the sections 19*b* and 23*b*, will have imparted thereto a rolling motion very closely corresponding to that which the ball had prior to its entry into the device.

It will be appreciated that while I have illustrated the use of merely a pair of guide rods to form the respective guide means, the concept of the invention may be applied to the use of a greater number of individual guide rods, as well as to guide rods involving curved lines of ball travel. Likewise, while I have illustrated a construction in which the cue ball travels straight through the device and the numbered balls are discharged laterally, the structure may be so designed that the numbered balls travel straight through the structure and the cue ball is discharged in a transverse direction.

It will be further appreciated that while I have illustrated the use of a metal separation structure employing metal rods, it may be desirable in some cases to fabricate the structure out of other materials as for example a molded plastic structure or the like. However, it is believed that the preferred embodiment illustrated offers greater reliability due to the inherent rigidity of parts and the ability to assemble the parts with the desired degree of accuracy.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. A device for separating a ball of one diameter from a ball of slightly larger diameter, comprising guide means forming a two-rail track, the rails of which are uniformly spaced a distance less than the diameter of either ball, supportingly conducting all balls to a separating station, one of the rails of said track operatively terminating the support of said smaller ball at said station, the other of said rails having an extended portion continuing through the separating station, and a third rail supported higher than and cooperating with said extended portion of said other rail and uniformly spaced therefrom a distance greater than the diameter of the smaller ball and less than the diameter of the larger ball, said third rail being so disposed with respect to said extended portion that the larger ball will be supportingly guided by said third rail and said extended portion through the separating station approximately forming a continuation of the first line and that the smaller ball, by being unsupported by said third rail will thereby be separated at said separating station by the action of gravity.

2. A device according to claim 1, wherein the spacing between saod portion of the third rail and the extended portion of said one rail is substantially the mean of the maximum tolerance diameter of the smaller ball and the minimum tolerance diameter of the larger ball.

3. A device according to claim 1, wherein said rails are in the form of respective rod members having a diameter considerably less than that of the balls.

4. A device according to claim 1, wherein said other rail and extended portion thereof extend in a straight line.

5. A device according to claim 1, wherein said rail operatively terminating the support of the smaller ball at said separation station and said third rail are formed from a single member, and connected by an offset portion.

6. A device according to claim 5, wherein said third rail portion is connected by an offset portion to a fourth rail portion beyond said separating station extending in uniformly spaced relation with respect to a further continuation of said extended portion of said other rail, with the spaced relation substantially equal to the distance between the rails of said track originally conducting said balls to said separating station.

7. A device according to claim 6, wherein said other rail together with said extended portion and further continuation thereof extends in a straight line, and third rail portion being straight and parallel and higher than said extended portion of said other rail, said third rail portion being respectively connected to said one rail portion at the entrance of said separating station and connected to said fourth rail portion at the exit of said separating station by longitudinally arcuate rails having a radius of curvature to support one side of said larger ball but not said smaller ball so as to form a continuous rail for support of said larger ball to carry it through said separating station and therebeyond in cooperation with said straight other rail with said smaller ball being separated by nonsupport due to the greater distance between said arcuate and third rail from said straight other rail than the diameter of said smaller ball.

8. A device according to claim 7, comprising further means for directing the small ball from said separating station, in the form of an inclined ramp, disposed to receive the smaller ball following its movement out of engagement with said third rail portion.

* * * * *